US011345505B2

(12) United States Patent
McKale

(10) Patent No.: US 11,345,505 B2
(45) Date of Patent: May 31, 2022

(54) CAPPED BARREL SYSTEM AND METHODS

(71) Applicant: INNOVATIVE DISTILLING TECHNOLOGIES, INC., Tecumseh (CA)

(72) Inventor: Mark Joseph McKale, Tecumseh (CA)

(73) Assignee: INNOVATIVE DISTILLING TECHNOLOGIES, INC., Tecumseh (CA)

( * ) Notice: Subject to any disclaimer, the term of this patent is extended or adjusted under 35 U.S.C. 154(b) by 0 days.

(21) Appl. No.: 16/997,170

(22) Filed: Aug. 19, 2020

(65) Prior Publication Data

US 2022/0055787 A1 Feb. 24, 2022

(51) Int. Cl.
*B65D 1/16* (2006.01)
*B65D 43/02* (2006.01)

(52) U.S. Cl.
CPC ..... *B65D 1/16* (2013.01); *B65D 43/022* (2013.01); *B65D 2543/00092* (2013.01); *B65D 2543/00296* (2013.01)

(58) Field of Classification Search
CPC ..... B65D 1/16; B65D 43/022; B65D 2543/00092; B65D 2543/00296; B65D 9/04; B65D 21/0217; B65D 39/0041; C12H 1/22
USPC ..... 220/72; 217/81
See application file for complete search history.

(56) References Cited

U.S. PATENT DOCUMENTS 39,274 A 7/1863 Connolly
116,398 A 6/1871 Barsaloux
603,348 A 5/1898 Thompson
616,563 A 12/1898 Taylor
625,573 A 5/1899 Leavitt
886,981 A 5/1908 Hurst
(Continued)

FOREIGN PATENT DOCUMENTS

CA 2929204 A1 11/2016
DE 2226217 A1 12/1973
(Continued)

OTHER PUBLICATIONS

United Kingdom Application No. GB1607896.6, Search Report mailed Nov. 22, 16; p. 4.

*Primary Examiner* — Valentin Neacsu
*Assistant Examiner* — Eric C Baldrighi
(74) *Attorney, Agent, or Firm* — Taft Stettinius & Hollister LLP; William Michael Etienne

(57) ABSTRACT

A capped barrel system for aging liquids includes a barrel and a barrel cap removably coupled to the barrel. The barrel includes: a plurality of wooden staves suitable for aging liquids, hoops for holding the staves together, a head coupled to the staves, and a bunghole formed in the head. The barrel cap includes: a lid including a top portion and a rim extending downwardly from the top portion. The rim includes an inner surface and a seal that defines at least a portion of the inner surface. The barrel cap further includes an opening formed in the top portion of the lid that is generally aligned with the bunghole and a closure removably positioned in the opening. When the closure is positioned in the opening, a gas tight coupling between the closure and the lid and a gas tight fit between the seal and the barrel form a gas tight environment between the barrel and the barrel cap.

15 Claims, 8 Drawing Sheets

(56) References Cited

U.S. PATENT DOCUMENTS

| | | | | |
|---|---|---|---|---|
| 923,461 | A | 6/1909 | Strehli | |
| 1,133,688 | A | 3/1915 | Wiedeman et al. | |
| 1,267,542 | A | 5/1918 | Hanson | |
| 1,320,862 | A | 11/1919 | Irey | |
| 2,010,109 | A | 8/1935 | Rice | |
| 2,538,682 | A | 1/1951 | Gramelspacher | |
| 2,792,692 | A * | 5/1957 | Bryan | F25D 31/006 62/306 |
| 2,829,794 | A | 4/1958 | Epps | |
| 2,952,377 | A | 9/1960 | Brown et al. | |
| 3,064,849 | A | 11/1962 | Ferm | |
| 3,815,774 | A | 6/1974 | Olsson | |
| 3,912,110 | A | 10/1975 | Hammes | |
| 6,401,957 | B1 | 6/2002 | Przytulla | |
| 9,032,864 | B2 * | 5/2015 | Roleder | C12H 1/16 99/277.1 |
| 2006/0032858 | A1 | 2/2006 | Lee et al. | |
| 2006/0037485 | A1 | 2/2006 | Ho | |
| 2009/0255927 | A1 * | 10/2009 | Flecknoe-Brown | B65D 51/16 220/4.13 |
| 2016/0326474 | A1 * | 11/2016 | McKale | C12H 1/22 |
| 2019/0389630 | A1 * | 12/2019 | Kirchner | B65D 39/0094 |

FOREIGN PATENT DOCUMENTS

| | | | | |
|---|---|---|---|---|
| DE | 29800062 | U1 | 3/1998 | |
| DE | 202006004354 | U1 | 7/2007 | |
| DE | 102007060725 | A1 | 5/2009 | |
| EP | 0761556 | A1 | 3/1997 | |
| GB | 173333 | A | 1/1922 | |
| GB | 154325 | A | 9/1936 | |
| GB | 2526373 | A | 11/2015 | |
| GB | 2540845 | A | 2/2017 | |
| WO | 2004094237 | A2 | 11/2004 | |
| WO | WO-2013117060 | A1 * | 8/2013 | B65D 51/1683 |

* cited by examiner

CAPPED BARREL SYSTEM AND METHODS

FIELD OF THE DISCLOSURE

The present disclosure relates to liquid containers such as barrels, casks, and tuns. In particular, the embodiments disclosed herein relate to systems and methods for capping barrels for aging liquids.

BACKGROUND

Barrels are often used to age liquids such as wine or spirits. Such barrels tend to include a plurality of staves arranged to form a round storage container. Any such barrel will likely include a head located toward one end of the staves. Traditionally, barrels were stored on their sides, but more recently, barrels have been stored in an upright or vertical position such that the head is positioned at a top side of the barrel.

A barrel may have a bunghole formed in the head, which is configured to receive a bung to prevent spillage of liquids stored within the barrel. Over time, the bung and the head may warp, crack, and become porous. When a wine or spirit ages in the barrel, small amounts of oxygen are introduced because the barrel allows some air to enter an interior portion thereof where the liquid is stored. A significant portion of the liquid may be lost due to evaporation. These losses may be as high as 10% in the first year, and may be approximately 3% in subsequent years.

Therefore, what is needed is a system and method for efficiently and cost effectively reducing the amount of liquid loss due to evaporation. In other words, what is needed is a system for providing a gas tight environment for the barrel and an efficient method of use and method of manufacture for components of the system.

SUMMARY

In an illustrative embodiment, a capped barrel system for aging liquids comprises: a barrel including: a plurality of staves made of a wood suitable for aging liquids, at least one hoop for holding the staves together, a head coupled to the staves, a bunghole formed in the head, and an exterior surface formed at least in part by the plurality of staves; and a barrel cap removably coupled to the barrel and including: a lid including a top portion positioned above the head of the barrel and a rim extending downwardly from the top portion, the rim includes an inner surface, an outer surface, and a seal that defines at least a portion of the inner surface and cooperates with the exterior surface of the barrel to provide a gas tight fit between the barrel and the barrel cap; an opening formed in the top portion of the lid that is generally aligned with the bunghole; and a closure removably positioned in the opening to seal the opening.

In some embodiments, the barrel cap is devoid of a spout extending downwardly from the opening formed in the lid.

In some embodiments, the closure is non-frangible.

In some embodiments, the closure includes a bottom fin that is positioned below the opening. In some embodiments, the opening has a first diameter, and the bottom fin of the closure has a second diameter that is greater than the first diameter.

In some embodiments, the closure includes a recessed portion positioned above the bottom fin, and the recessed portion has a third diameter that is lesser than the second diameter. In some embodiments, the third diameter is substantially equal to the first diameter.

In some embodiments, the closure includes a top fin having a fourth diameter that is greater than the first diameter and third diameter, and the recessed portion is positioned between the bottom fin and the top fin.

In some embodiments, the bottom fin includes a tapered portion.

In some embodiments, the seal is comprised of thermoplastic elastomeric material. In some embodiments, the closure is comprised of thermoplastic elastomeric material. In some embodiments, the thermoplastic elastomeric material of the closure has a greater hardness than the thermoplastic elastomeric material of the seal.

In some embodiments, the lid and the closure consist of the same material or materials.

In some embodiments, the top portion of the lid is comprised of a first material having a first hardness; and the seal of the lid is comprised of a second material having a second hardness that is lesser than the first hardness.

In some embodiments, the lid is a first lid and the barrel cap is a first barrel cap. The capped barrel system further comprises a second barrel cap configured to be coupled to the barrel and including: a second lid including: (i) a top portion positioned above the head of the barrel when the second barrel cap is coupled to the barrel and (ii) a rim extending downwardly from the top portion, wherein the rim includes an inner surface, an outer surface, and a seal that defines at least a portion of the inner surface and cooperates with the exterior surface of the barrel to provide a gas tight fit between the barrel and the second barrel cap; an opening formed in the top portion of the second lid that is generally aligned with the bunghole when the second barrel cap is coupled to the barrel; and the seal of the first lid has a first thickness, the seal of the second lid has a second thickness that is less than the first thickness, and the seal of the second lid does not form a gas tight fit with the barrel when the second barrel cap is coupled to the barrel.

In some embodiments, the lid is a first lid and the barrel cap is a first barrel cap. The capped barrel system further comprises a second barrel cap configured to be coupled to the barrel and including: a second lid including: (i) a top portion positioned above the head of the barrel when the second barrel cap is coupled to the barrel, and (ii) a rim extending downwardly from the top portion, wherein the rim includes an inner surface, an outer surface, and a seal that defines at least a portion of the inner surface and cooperates with the exterior surface of the barrel to provide a gas tight fit between the barrel and the second barrel cap; and an opening formed in the top portion of the second lid that is generally aligned with the bunghole when the second barrel cap is coupled to the barrel; the seal of the first lid has a first thickness, the seal of the second lid has a second thickness that is different than the first thickness; and the closure is positionable in the opening of the second lid to seal the opening of the second lid.

In another illustrative embodiment, a method of using a capped barrel system including a barrel and a barrel cap includes: removing a closure from an opening formed in the barrel cap; removing liquid from the barrel; and repositioning the closure in the opening formed in the barrel cap to provide a gas tight environment between the barrel cap and the barrel.

In some embodiments, repositioning the closure in the opening includes: passing a fin of the closure which has a first diameter through the opening which has a second diameter that is lesser than the first diameter.

In some embodiments, the method further includes: positioning the barrel cap on the barrel, which has a head and a bunghole formed in the head, prior to removing a closure from an opening formed in the barrel cap.

In some embodiments, the method further includes: inserting a draining stem through the opening formed in the barrel cap prior to removing liquid from the barrel; and removing the draining stem from the opening formed in the barrel cap subsequent to removing liquid from the barrel.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein:

FIG. 1 shows that the barrel cap includes a closure configured to be positioned in an opening formed in the barrel cap;

FIG. 4 shows that the barrel cap includes a seal;

FIG. 5 shows that the different barrel cap includes a seal having a lesser thickness than a thickness of the seal of the barrel cap shown in FIGS. 1-4;

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
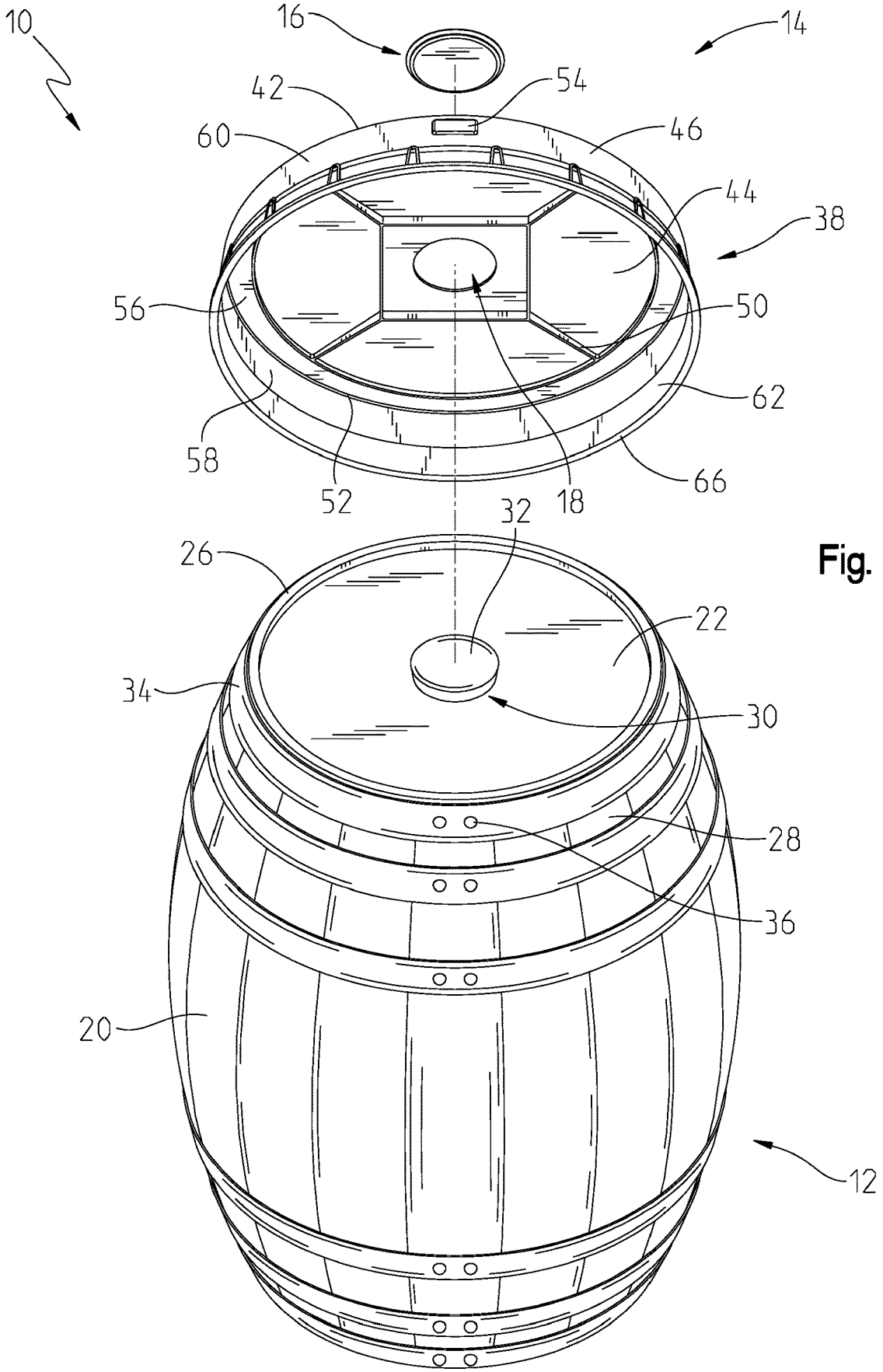
FIG. 1 illustrates a modified perspective view of a barrel, a bung positioned in a bunghole of the barrel, and a barrel cap configured to be positioned on the barrel.

FIG. 1 shows an exemplary or illustrative embodiment of a capped barrel system 10 including a barrel 12 and a barrel cap 14 configured to be positioned on the barrel 12. The barrel cap 14 includes a closure 16 configured to be positioned in an opening 18 formed in the barrel cap 14. The barrel cap 14 and the closure 16 are arranged to form a gas tight coupling when the closure 16 is positioned in the opening 18. Similarly, when the barrel cap 14 is positioned on the barrel 12, the barrel 12 and the barrel cap 14 are arranged to have a gas tight fit. It should be appreciated that the term gas tight is used to indicate a fit, coupling, connection, seal, or environment that is sufficient to hold pressure in a barrel relatively constant over time, for example, more constant than would a similar barrel lacking the barrel cap 14.

In the illustrative embodiment, the barrel 12 is a hollow container including a plurality of staves 20 and a head 22 coupled to the plurality of staves 20. The staves 20 are arranged to form a cylindrical body, which may include a convex curvature bulging at a bilge located along a middle portion of the barrel 12. The barrel 12 may include one or more hoops 34 extending around exterior surfaces of the staves 20 to secure the staves 20 in the cylindrical arrangement. The staves 20 cooperate with the one or more hoops 34 to form an exterior surface 28 of the barrel 12. The staves 20 may be comprised of, for example, wood or any other material suitable for aging liquids stored in an interior of the barrel 12. The hoops 34 may be comprised of, for example, metal or any other material suitable for holding the staves 20 together. Terminating ends of the hoops 34 may be secured together via fasteners or rivets 36, as shown in FIG. 1.

In the illustrative embodiment, the head 22 of the barrel 12 is flat, circular and positioned at a top side of the barrel 12. In some embodiments, the head 22 may be convex to prevent debris from entering the interior portion of the barrel 12 through an opening in the head of the barrel 12, which is described in greater detail below. The head 22 is surrounded by raised ends of the staves 20, which protrude upward beyond the head 22. The raised ends of the staves 20 form a chime 26 of the barrel 12, which is the uppermost portion of the barrel 12. In some embodiments, a trench is formed along interior surfaces of the staves 20, and an outer edge of the head 22 is positioned in the trench.

The barrel 12 may include a bunghole 30, which facilitates the addition or removal of liquids to or from the interior of the barrel 12. In the illustrative embodiment, the bunghole 30 is the opening formed in the head 22. As shown in FIG. 1, in the illustrative embodiment, the barrel 12 includes a bung 32 removably positioned in the bunghole 30. When the bung 32 is positioned in the bunghole 30, spillage of liquid from the bunghole 30 may be mitigate; however, evaporation of liquid is not effectively prevented. Further, the bung 32 may prevent debris resting on the head 22 of the barrel 12 from entering the interior of the barrel 12 where the liquids are stored; although, debris may be prevented from entering the interior of the barrel 12 using other components as well, such as the barrel cap 14.

As shown in FIG. 1, in the illustrative embodiment, the bung 30 protrudes upward from the head 22 of the barrel 12, such that any downwardly extending component aligned with or positioned nearby the bunghole 30 may interfere with the arrangement of the bung 32 or with the removal or insertion process of the bung 32. Therefore, any such downwardly protruding component, for example a spout for guiding a draining hose or the like, may be undesirable, especially as a result of the bung 32 being positioned in the bunghole 30.

The bung 32 may be comprised of silicone, cork, wood, or any other suitable material for preventing spillage of liquids from the bunghole 30. The bung 32 may be removed from the bunghole 30 and reused (i.e. reinserted), which may damage the integrity of bung 32 over time. The bung 32, among other factors, may contribute to evaporative losses of the liquids stored within the barrel 12. For example, the head 22 of the barrel 12 may dry over time due to lack of contact with liquid, which may create gaps between the bunghole 30 and the bung 32. Further warping or cracking of the head 22 may compromise the coupling formed between the head 22 and the staves 20, which may further contribute to evaporative losses of the liquids stored within the barrel 12.

Figure 2:
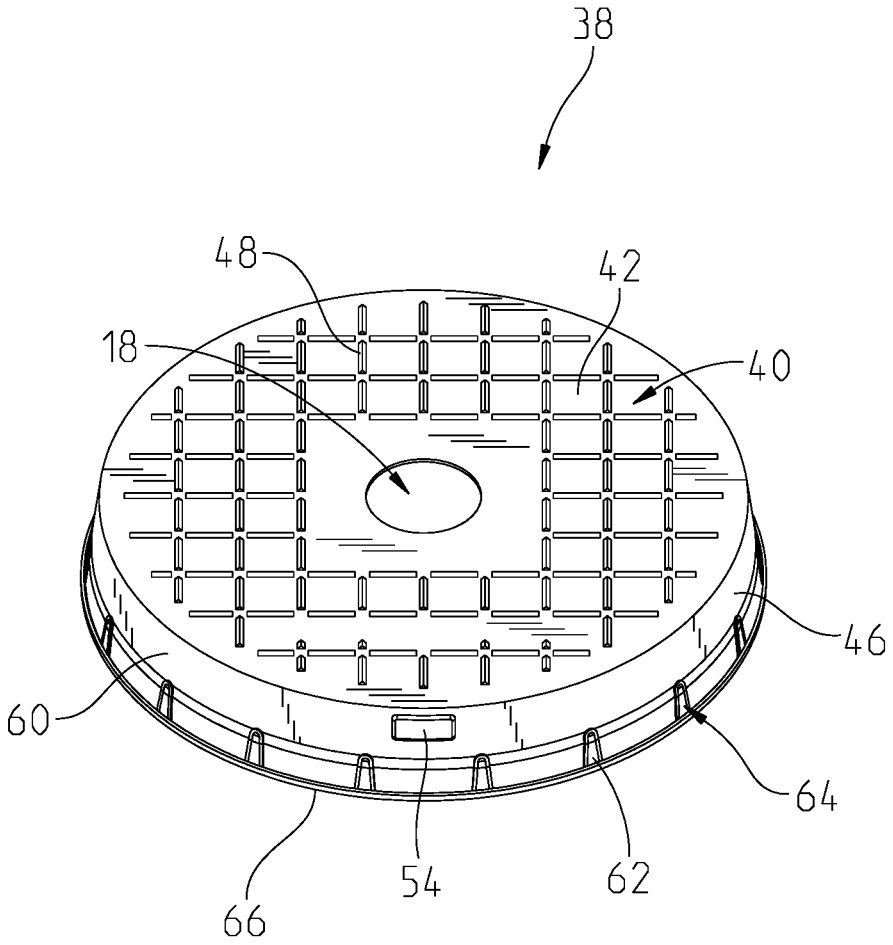
FIG. 2 illustrates a top perspective view of the barrel cap with the closure removed from the opening.

To counteract evaporative liquid losses and extend the life of the barrel 12, this disclosure contemplates the barrel cap 14, which forms a gas tight fit with the barrel 12. As shown in FIG. 2, the barrel cap 14 includes a lid 38. The lid 38 includes a top portion 40 having an upper surface 42 (see FIG. 2) and a lower surface 44 (see FIG. 3). The lid 38 also includes a rim 46 extending downwardly from the lower surface 44 of the top portion 40 of the lid 38. The opening 18 is formed in the top portion 40 of the lid 38 and extends through the upper surface 42 and the lower surface 44 thereof.

In the illustrative embodiment, the top portion 40 of the lid 38 includes a plurality of protrusions 48 extending upwardly from the upper surface 42. The protrusions 48 may extend linearly, as shown in FIG. 2, or may be curved. In the illustrative embodiment, the protrusions 48 are arranged in a grid-like pattern. In other embodiments, the protrusions 48 may be replaced with indentations. The grid-like arrangement may be advantageous for preventing movement of capped barrels stacked on top of one another. This disclosure contemplates other arrangements of protrusions and/or indentations suitable for preventing movement of stacked, capped barrels as well. For example, the protrusions and/or indentations may take the form of a continuous or non-continuous circular shape approximating a bottom edge of a barrel. Accordingly, this disclosure contemplates systems and methods in which multiple barrels are capped and stacked vertically on top of one another.

Figure 3:
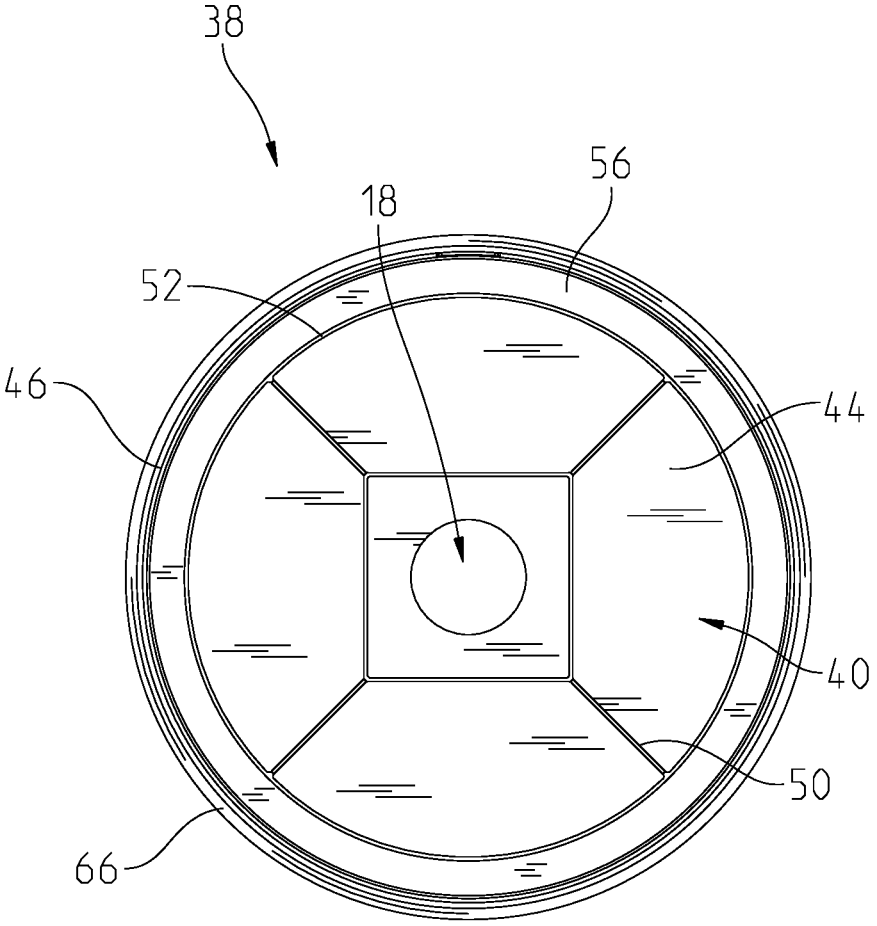
FIG. 3 illustrates a bottom plan view of the barrel cap with the closure removed from the opening.

As shown in FIGS. 1 and 3, in the illustrative embodiment, the top portion 40 of the lid 38 includes additional protrusions 50 extending downwardly from the lower surface 44. These additional protrusions may be referred to as ribbing 50. While the ribbing 50 extends downwardly relative to the opening 18, the ribbing 50 is spaced apart from the opening 18 such that the ribbing 50 does not interfere with the bung 32 or processes involving the bung 32.

The ribbing 50 is sized and arranged to contact the head 22 of the barrel 12 when the barrel cap 14 is positioned on the barrel 12. For example, in some embodiments, the ribbing 50 may extend downwardly from the lower surface 44 approximately the same distance as the chime 26 extends upwardly beyond the head 22. Therefore, when the barrel cap 14 is positioned on the barrel 12, the chime 26 may contact the lower surface 44 (of the top portion 40) of the lid 38 while the ribbing 50 contacts the head 22. In this arrangement, the top portion of 40 of the lid 38 is supported by the ribbing 50. Due at least in part to the ribbing 50, the top portion 40 is prevented from deform downwardly toward the head 22 as additional barrels are stacked on top of the capped barrel 12. Therefore, the ribbing 50 increases the structural integrity of capped barrels in a stacked configuration.

In the illustrative embodiment shown in FIGS. 1 and 3, the ribbing 50 includes a circular portion 52 arranged concentrically with a ring portion 56 of the lower surface 44. As shown in FIGS. 1 and 3, the ring portion 56 of the lower surface 44 is defined between the rim 46 and the circular portion 52 of the ribbing 50. When the barrel cap 14 is positioned on the barrel 12, the chime 26 may contact the ring portion 56 of the lower surface 44. Accordingly, when the barrel cap 14 is positioned on the barrel 12, the circular portion 52 of the ribbing 50 is arranged concentrically with the chime 26 and positioned radially inward of the chime 26.

While in some instances, the chime 26 may form a gas tight seal with the lower surface 44 of the lid 38, in the illustrative embodiment, a gas tight fit is formed with another portion of the lid 38, as will be described in greater detail below. In instances in which the chime 26 forms a gas tight seal with the lower surface 44 of the lid 38, a downward force or weight may be required to properly form the gas tight seal. Accordingly, forming a gas tight fit with other components of the barrel 12 and the barrel cap 14 (i.e. instead of or in addition to via contact between the chime 26 and the lower surface 44 of the lid 38) may be advantageous. This is especially true when a capped barrel 12 is not arranged in a stacked configuration below another barrel.

As shown in FIG. 3, in the illustrative embodiment, the ribbing 50 includes a square portion with diagonal portions extending between the square portion and the circular portion 52. While portions of the ribbing 50 may take various shapes, the shapes described herein are advantageous because each portion provides support to the top portion 40 of the lid 38 without interfering with the arrangement of components of the barrel 12 such as the bung 32.

Referring again to FIGS. 1 and 2, the lid 38 further includes a cavity 54 extending radially outwardly from the rim 46. In the illustrative embodiment, the cavity 54 is shaped as a rectangle. The cavity 54 is sized and shaped to receive the rivets 36, which couple together terminating ends of the head hoop 22. Accordingly, when the barrel cap 14 is positioned on the barrel 12, the rivets 36 are positioned in the cavity 54.

As shown in FIGS. 1 and 2, the rim 46 includes an inner surface 58, an outer surface 60, and a seal 62. The seal 62 defines at least a portion of the inner surface 58. When the barrel cap 14 is positioned on the barrel 12, the seal 62 contacts the exterior surface 28 of the barrel 12 to form a gas tight fit therewith. In the illustrative embodiment, the seal 62 contacts the exterior surface 28 of the barrel 12 along the exterior surfaces of the staves 20 at a location directly adjacent and below the head hoop 22. In other embodiments, the seal 62 may contact the exterior surface 28 of the barrel 12 at other locations along the exterior surface 28.

In the illustrative embodiment, the seal 62 is comprised of a thermoplastic elastomeric material (TPE). In the illustrative embodiment, the portions of the lid 38 excluding the seal 62 are comprised of high density polyethylene (HPDE), which has a greater hardness than TPE. For example, the top portion 40 is comprised of HDPE. Therefore, the lid 38, which has a TPE seal 62 and an HDPE top portion 40, is comprised of two materials with different hardness values; this is advantageous because a softer material (i.e. TPE) may be more effective in forming a gas tight fit while a harder material (i.e. HDPE) may be more effective in weight-bearing arrangements, such as when another barrel is stacked on top of the capped barrel 12.

While the exemplary lid 38 is described as including a first portion having a first hardness and a separate portion having a different hardness, this disclosure also contemplates a lid that is a single, monolithic structure comprised of one material, which is suitable for bearing the weight of stacked barrels and for forming a gas tight fit with an exterior surface of a barrel to which the lid is coupled. In any event, relative hardness values are described in accordance with the Shore Hardness Scales inclusive of each individual Shore Hardness Scale (Shore 00, Shore A, and Shore D).

In the illustrative embodiment shown in FIG. 2, the rim 46 includes a plurality of grooves 64 formed therein. The grooves 64 open downwardly away from the top portion 40 of the lid 38. The grooves 64 facilitate flexing of the rim 46, especially when the barrel cap 14 is positioned on the barrel 12, which improves the structural integrity of the barrel cap 14. In the illustrative embodiment, as shown in FIG. 2, portions of the seal 62 are positioned in the grooves 64.

In some embodiments, e.g., where the seal 62 is comprised of TPE and non-seal portions of the rim 46 are comprised of HDPE, the seal 62 extends radially outward beyond the non-seal portion of the rim 46. Accordingly, in such embodiments, the seal 62 defines at least a portion of the outer surface of the rim 46.

In the illustrative embodiment, as shown in FIGS. 1 and 2, the seal 62 defines the lowermost edge 66 of the rim 46. In the illustrative embodiment, as shown in FIG. 1, the seal 62 extends upwardly from the lowermost edge 66 to define at least a portion of the inner surface 58 of the rim 46.

In the illustrative embodiment, the seal 62 defines a portion, but not all, of the inner surface 58 of the rim 46. The careful positioning of the seal 64 is advantageous for providing a gas tight fit between the barrel cap 14 and the barrel 12 without the use of excess material comprising the seal 62. It should be appreciated that this disclosure contemplates other arrangements of the seal 62 so long as the seal 62 defines at least a portion of the inner surface 58 of the rim 46.

Figure 4:
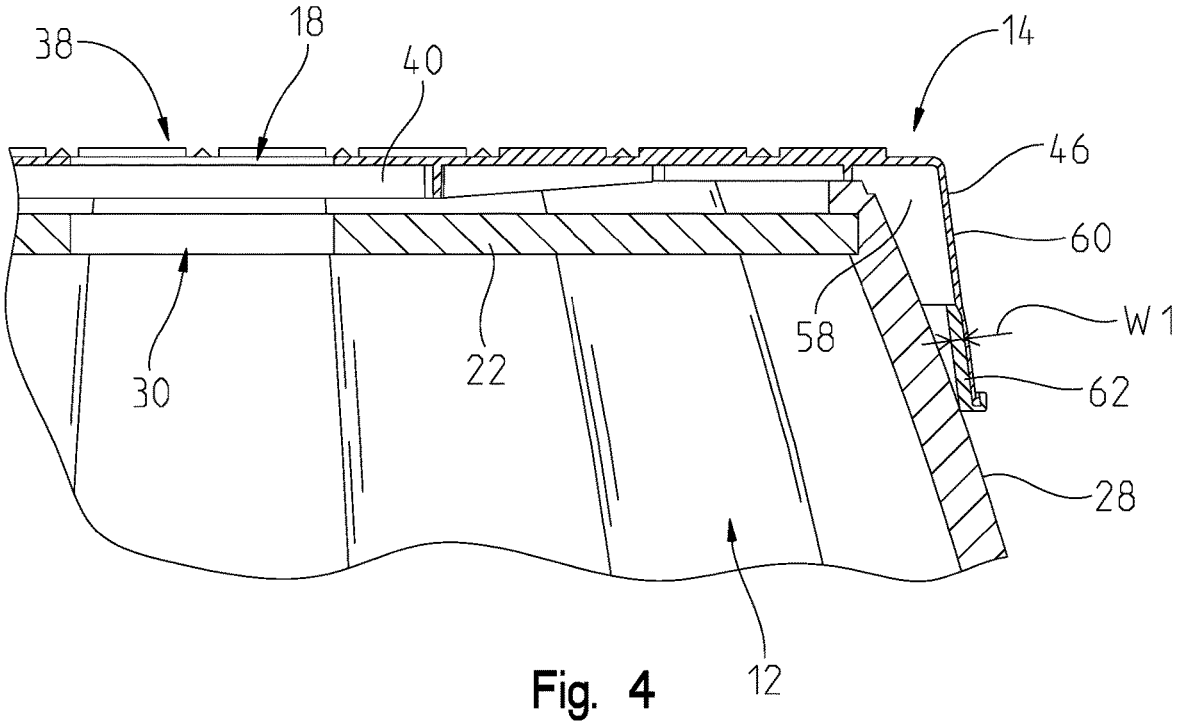
FIG. 4 illustrates a cross section view of the barrel cap positioned on the barrel.

FIG. 4 illustrates a truncated cross section view of the barrel cap 14 positioned on the barrel 12. The seal 62 is in contact with the exterior surface 28 of the barrel 12. The barrel cap 14 is coupled to the barrel 12 via a friction fit, meaning that the seal 62 is compressed against the exterior surface 28 of the barrel 12. Accordingly, the seal 62 is in a compressed state. In some embodiments, when the barrel cap 14 is coupled to the barrel 12, the non-seal portion of the rim 46 provides a radially inwardly biasing force to contribute to the compressed state of the seal 62. Therefore, in the illustrative embodiment, the barrel 12 and the non-seal portion of the rim 46 compress, and in some instances, deform the seal 62 to maintain the gas tight fit between the barrel 12 and the barrel cap 14. It should be appreciated that in the illustrative embodiment, the fit between the barrel 12 and the barrel cap 14 is not a mating-type fit nor a snap fit, but rather a friction fit, as described above.

Figure 5:
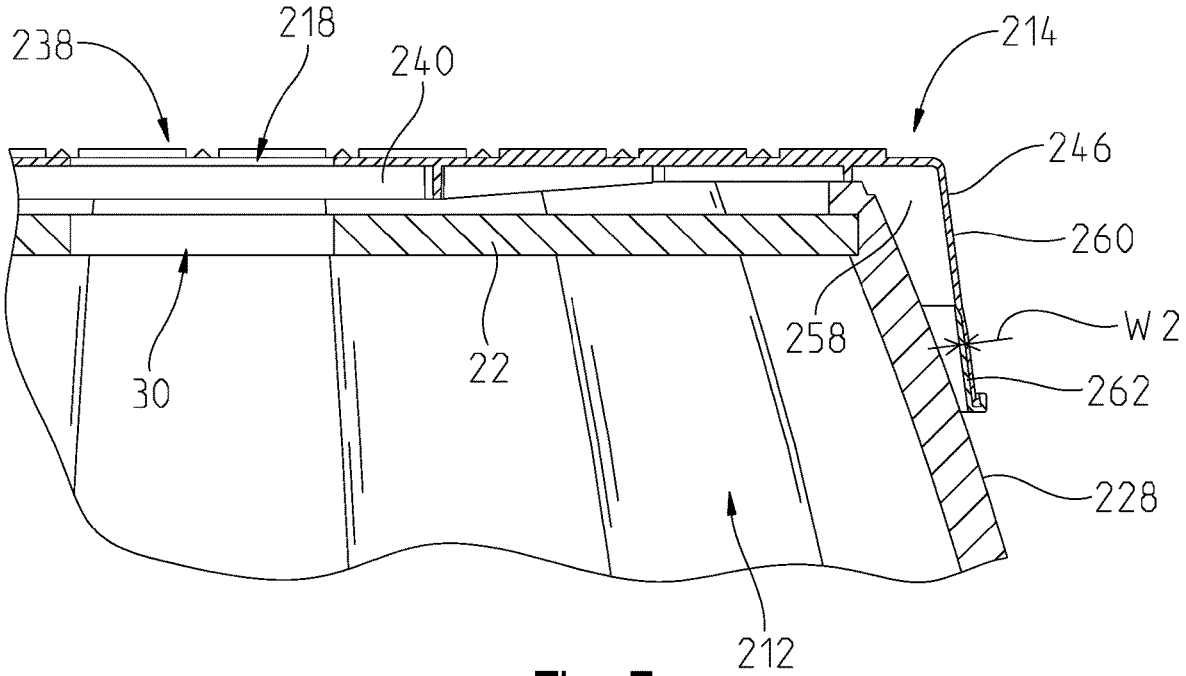
FIG. 5 illustrates a cross section view of a different barrel cap positioned on the barrel.

FIG. 5 illustrates a truncated cross section view of a second barrel cap 214. The second barrel cap 214 is configured to be removably coupled to the barrel 12 and/or to another barrel of a different size, as described below. The second barrel cap 214 includes a second lid 238 including a top portion 240. When the second barrel cap 214 is positioned on the barrel 12, the second lid 238 is positioned above the head 22 of the barrel 12. The second lid 238 includes a rim 246 extending downwardly from the top portion 240. The rim 246 includes an inner surface 258, an outer surface 260, and a seal 262 that defines at least a portion of the inner surface 258. The second barrel cap 214 includes an opening 218 formed in the top portion 240 of the second lid 238. The opening 218 is generally aligned with the bunghole 30 when the second barrel cap 214 is coupled to the barrel 212. It should be appreciated that unless otherwise noted, (i.e. excluding the seals 62, 262) the structure of the second barrel cap 214 is identical to the structure of the barrel cap 14. Further, unless otherwise noted, any additional disclosure relating to the barrel cap 14 applies with equal force to the second barrel cap 214.

As shown in FIGS. 4 and 5, the seal 62 of the lid 38 has a first thickness W1, and the seal 262 of the second lid 238 has a second thickness W2. The thickness W2 is less than the thickness W1. Accordingly, the seal 262 of the second lid 238 does not form a gas tight fit with the barrel 12 when the second barrel cap 214 is coupled to the barrel 12. In some embodiments, as shown in FIG. 5, a gap may be defined between the seal 262 and the exterior surface 28 of the barrel 12; however, in other embodiments, the seal 262 may be in contact with the exterior surface 28, yet not form a gas tight fit therewith.

In use, the second barrel cap 214 is preferably coupled to a second barrel, which has an exterior surface with a greater diameter than the exterior surface 28 of the barrel 12. Therefore, the second barrel cap 214 forms a gas tight fit with the second barrel.

This disclosure contemplates a third barrel having an exterior surface with a lesser diameter than the exterior surface 28 of the barrel 12. Similarly, this disclosure contemplates a third barrel cap including a third lid. The third lid includes a top portion and a rim extending downwardly from the top portion. The rim includes an inner surface and a seal that defines at least a portion of the inner surface. The seal cooperates with the exterior surface of the third barrel to provide a gas tight fit between the third barrel and the third barrel cap. To accommodate the lesser diameter of the exterior surface of the third barrel, the seal of the third barrel cap has a thickness that is greater than the thickness W1. Therefore, in some embodiments, the third barrel cap cannot be adequately positioned on the second (or first) barrel due to size restrictions. Likewise, in some embodiments, the barrel cap 14 cannot be positioned on the second barrel due to size restrictions.

In some embodiments, the thickness W1 of the seal 62 is approximately ⅜ in. The thickness W2 of the seal 262 is approximately ¼ in. The thickness of the seal of the third barrel cap is approximately ½ in. The term approximately is used to account for minor differences in size due to differences in thickness introduced during the manufacturing process.

In use, a user may selected any one of the barrel caps described above and attempt to couple the selected barrel cap to any one of the differently-sized barrels described above. If the selected barrel cap fits onto the barrel but does not form a gas tight fit therewith, the user may selected and couple a barrel cap having a thicker seal to the barrel. If the selected barrel cap does not fit onto the barrel due to size restrictions, the user may select and couple a barrel cap having a thinner seal to the barrel.

Figure 6:
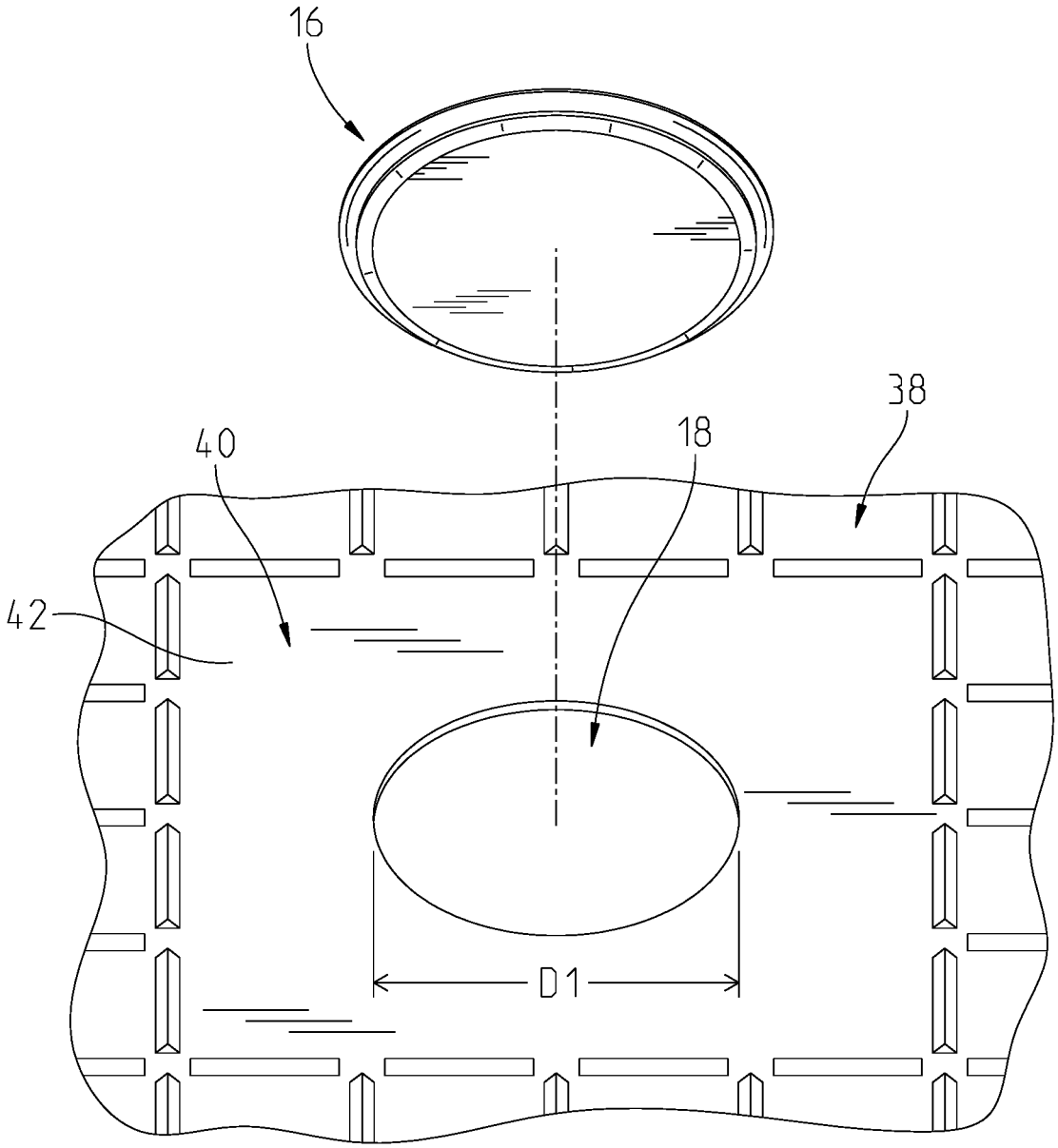
FIG. 6 illustrates a modified perspective view of the closure of FIG. 1 showing that the closure is configured to be positioned in the opening formed in the barrel cap.

FIG. 6 shows a modified perspective view of the closure 16, which is removably positionable in the opening 18 formed in the lid 38. In the illustrative embodiment, the closure 16 is comprised of TPE and HDPE. For example, the closure 16 may be comprised of 5% HDPE and 95% TPE, which is advantageous for providing a flexible closure 16, which sufficiently maintains its original shape after multiple insertions and removals from the opening 18 or under the pressure of aging liquids within the barrel 12.

In some embodiments, e.g., when the seal 62 is comprised of TPE and the non-seal portions of the lid 38 are comprised of HDPE, the closure 16 has a greater hardness than the seal 62 and a lesser hardness than the non-seal portions of the lid 38. In some embodiments, the lid 38 consists of only TPE and HDPE. In some embodiments, the closure 16 consists of only TPE and HDPE. Accordingly, the lid 38 and the closure 16 may consist of the same material or materials.

The closure 16 is non-frangible. Therefore, unlike frangible closures, which may need to be replaced with each subsequent use of the device to be closed, the non-frangible closure 16 is reusable with each subsequent use of the barrel cap 14 and the barrel 12. In other words, the closure 16 may be inserted into and removed from the opening 16 in repetition without destructing or permanently deforming the closure 16. Further, the closure 16 does not comprise adhesive material. When the closure 16 is positioned in the opening 18, the closure 16 withstands the force of the liquid contents within the barrel 12 without adhesive material securing the closure 16 to the lid 38. The gas tight coupling between the closure 16 and the lid 38, which allows the closure 16 to withstand the force of the liquid contents, will be described in more detail below.

It should be appreciated that the opening 18 is commonly-sized for each barrel cap described herein. Therefore, the closure 16 is removably positionable in the opening 18 of each barrel cap, regardless of the seal thickness (e.g., W1, W2) of the respective barrel cap. The opening 18 of each barrel cap has a diameter D1.

Figure 7:
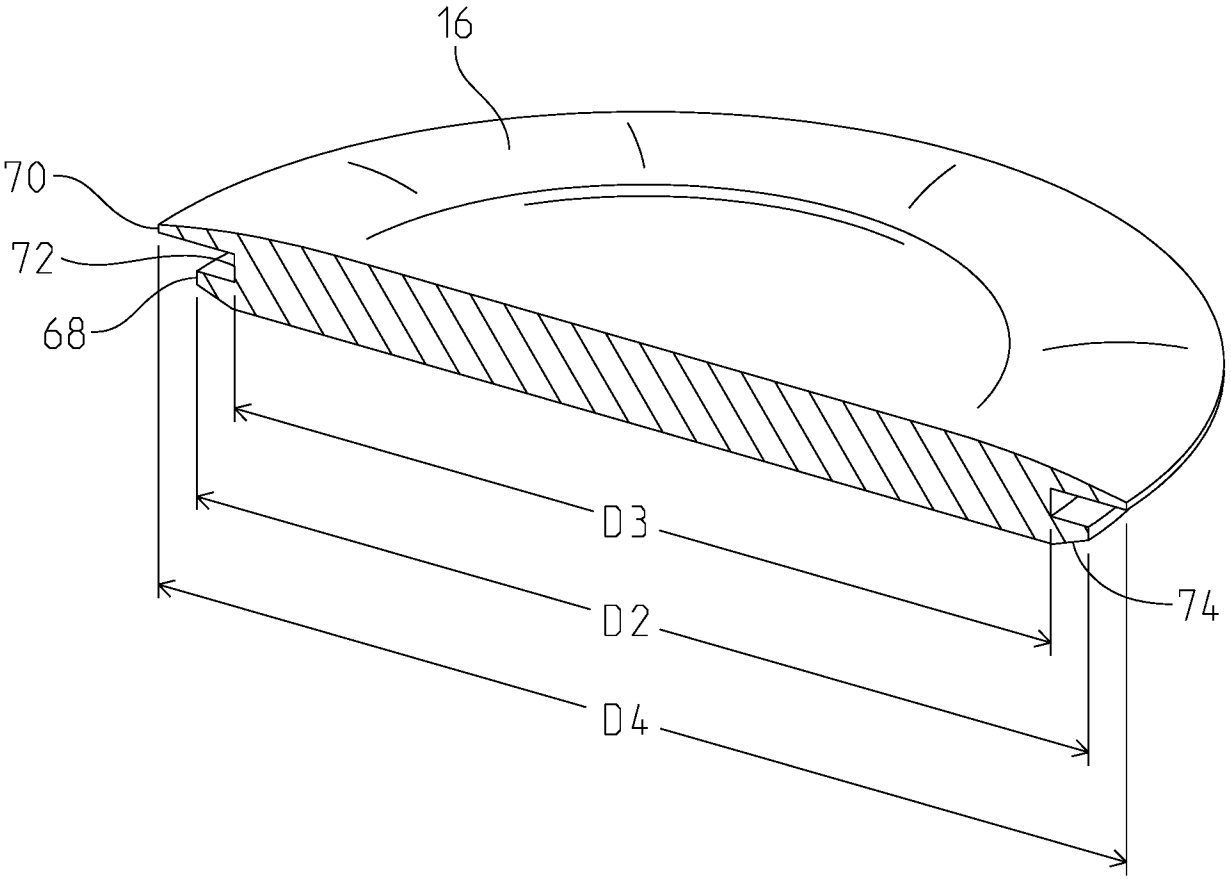
FIG. 7 illustrates a cross section view of the closure.

FIG. 7 illustrates a cross section view of the closure 16. In the illustrative embodiment, the closure 16 includes a bottom fin 68, a top fin 70, and a recessed portion 72 positioned vertically between the bottom fin 68 and the top fin 70. In the illustrative embodiment, the bottom fin 68, top fin 70, and recessed portion 72 are each circular. An outermost edge of the bottom fin 68 has a diameter D2 that is greater than the diameter of the opening D1. The recessed portion 72 has a diameter D3 that is less than the diameter of the bottom fin D2. In the illustrative embodiment, the diameter of the recessed portion D3 is approximately equal to the diameter of the opening D1. In the illustrative embodiment, an outermost edge of the top fin 70 has a diameter D4 that is greater than the diameter of the opening D1, greater than the diameter of the bottom fin D2, and greater than the diameter of the recessed portion D3.

In the illustrative embodiment, the bottom fin 68 includes a tapered portion 74 that narrows toward the outermost edge of the bottom fin 68. The tapered portion 74 facilitates insertion of the bottom fin 68 into the opening 18 and passage of the bottom fin 68 through the opening 18. In some embodiments, the top fin 70 may also include a tapered portion, which may aid in prevention of accidental removal of closure 16 from the opening 18.

Figure 8:
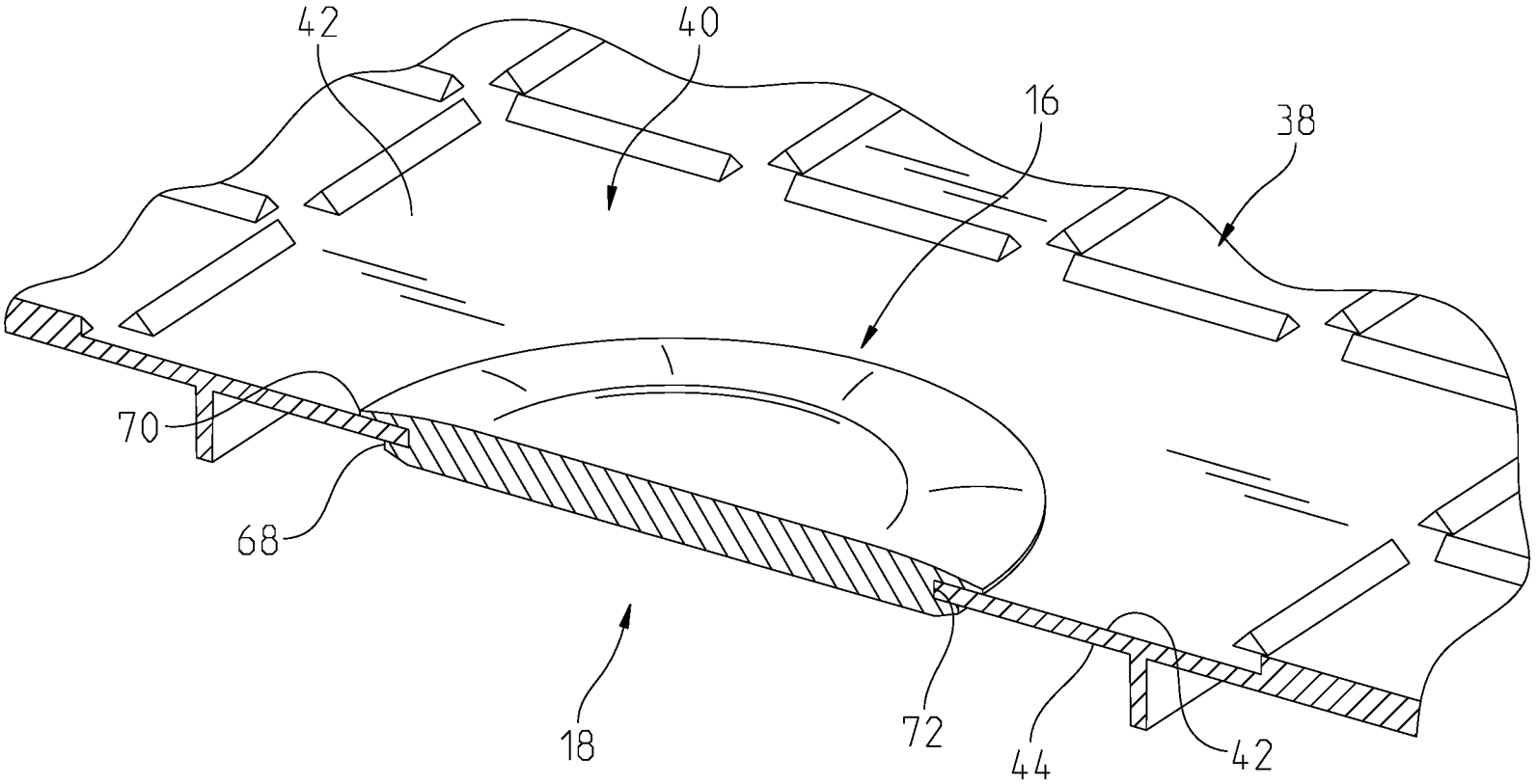
FIG. 8 illustrates a cross section view of the closure positioned in the opening formed in the barrel cap of FIG. 1.

FIG. 8 shows a truncated cross section view of the closure 16 positioned in the opening 18 of the lid 38. As shown in FIG. 8, in the illustrative embodiment, the bottom fin 68 of the closure 16 is positioned below the lower surface 44 of the top portion 40 of the lid 38. Likewise, the top fin 70 is positioned above the upper surface 42 of the top portion 40 of the lid 38. The recessed portion 72 is flush with (i.e. vertically aligned with) the upper and lower surfaces 42, 44 of the top portion of the lid 38. The arrangement of the top fin 70 above the upper surface 42 facilitates ease of removal of the closure 16 from the opening 18. For example, in use, a user may lift the outermost edge of the top fin 70 and pull upward on the closure 16 to remove the closure 16 from the opening 18.

The arrangement of the bottom fin 68 below the lower surface 44 allows the closure 16 to withstand the force of the liquid contents within the barrel 12 without leakage, and does so without adhesive material securing the closure 16 to the lid 38. Further, the closure 16 forms a gas tight coupling with the top portion 40 of the lid 38. The gas tight coupling between the closure 16 and the lid 38, and the gas tight fit between the seal 62 and the exterior surface 28 of the barrel cooperate to provide a gas tight environment between the barrel 12 and the barrel cap 14.

An exemplary method of use for a capped barrel system is described below. For example, in use, a user (e.g., manually or with mechanical, in some instances, automated assistance) may perform the following steps. Some or all of the steps of the steps described below may also be completed at the command of a controller having a memory and a processor configured to executed instructions (i.e. algorithmic steps) stored on the memory.

In any event, the closure 16 may be removed from the opening 18 formed in the top portion 40 of the lid 38. In some embodiments, such as a first use of the barrel cap 14, the barrel cap 14 may be previously disposed in a removed condition such that the initial removal step is unnecessary. In some embodiments, such as a first-use situation, a user may position the barrel cap 14 on barrel 12 such that the seal 62 forms a gas tight fit with the exterior surface 28 of the barrel 12.

With the closure 16 removed from the opening 18, liquid may be added to the interior of the barrel 12. The liquid-adding step may occur prior to or after the barrel cap 14 is positioned on the barrel 12. In some embodiments, the bung 32 may be inserted into the bunghole 30 of the barrel 12 after the liquid has been added to the barrel 12. After the liquid has been added to the barrel 12, the closure 16 is inserted into the opening 18 of the barrel cap 14.

Figure 9:
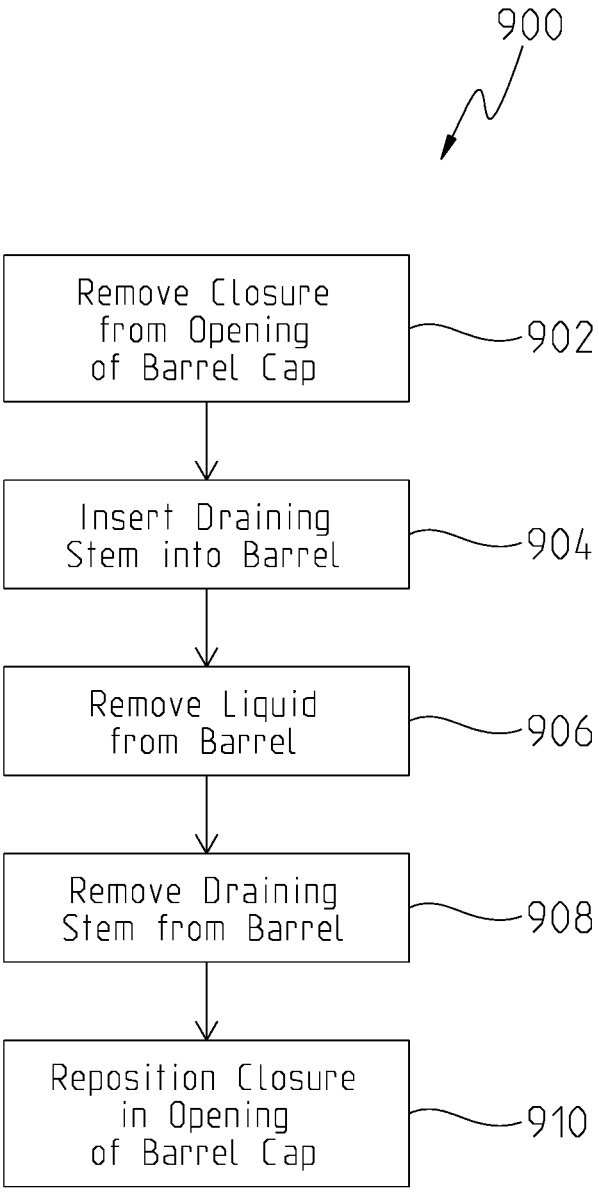
FIG. 9 illustrates a flow chart showing a method of using a capped barrel system.

With liquid in the barrel 12, and with the barrel cap 14 positioned on the barrel 12 forming a gas tight fit therebetween, the follow steps may be performed. Such steps may be included in a method 900, as shown in FIG. 9. As shown in step 902, the closure 16 may be removed from the opening 18 formed in the top portion 40 of the lid 38. As suggested by step 904, a draining stem may be inserted: (i) through the opening 18 formed in the top portion 40 of the lid 38, (ii) through the bunghole 32 formed in the head 22 of the barrel 12, and (iii) into the interior of the barrel 12. As suggested by step 906, using negative pressure (i.e. suction) from a pump or other means, the liquid may be removed from the barrel 12 via the draining stem. Subsequently, as suggested by step 908, the draining stem may be removed from the barrel and the opening 18 formed in the top portion 40 of the lid 38. Subsequently, additional liquid (to be aged) may be added to the same barrel 12. Subsequently, as shown in step 910, the same closure 16 may be reinserted in the opening 18 to reseal the opening 18 (i.e. to reintroduce the gas tight coupling between the closure 16 and the lid 38). In some embodiments, repositioning the closure 16 in the opening 18 to reseal the opening 18 includes: passing the bottom fin 68 of the closure 16 through the opening 18 such that the bottom fin 68 is positioned below the lower surface 44 of the top portion 40 of the lid 38.

An exemplary method of manufacturing the lid 38 is described below. The method includes molding a first portion of the lid 38 with a first mold. The first portion of the lid 38 may be the entire lid 38 with the exception of the seal 62. The first portion of the lid 38 may be referred to as a non-seal portion of the lid 38. The method further includes molding a second portion of the lid 38 using a second mold in combination with the first portion of the lid 38. In other words, the second portion of the lid 38 may be molded between the first portion of the lid 38 and a second mold. In this instance, the first portion of the lid 38 acts as a substrate. The second portion of the lid 38 may be the seal 62. The first portion of the lid 38 may be molded from a first material, which may be HDPE. The second portion of the lid 38 may be molded from a second material, which may be TPE. The method described above is an exemplary method of manufacture, and it should be appreciated that in other embodiments the lid 38 may be molded or otherwise formed from a signal material.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A capped barrel system for aging liquids comprising:

a barrel including:

a plurality of staves made of a wood suitable for aging liquids, at least one hoop for holding the staves together, a head coupled to the plurality of staves, wherein raised ends of the plurality of staves form a chime that extends upwardly beyond the head;

a bunghole formed in the head, and an exterior surface formed at least in part by the plurality of staves; and a barrel cap removably coupled to the barrel and including:

a lid including a top portion positioned above the head of the barrel and a rim extending downwardly from the top portion, wherein the rim includes an inner surface, an outer surface, and a seal;

wherein the seal defines at least a portion of the inner surface and cooperates with and contacts the exterior surface of the barrel at a location below and spaced apart from the chime to provide a gas tight fit between the barrel and the barrel cap, and an opening formed in the top portion of the lid that is generally aligned with the bunghole; and a closure removably positioned in the opening to seal the opening.

2. The capped barrel system of claim 1, wherein the barrel cap is devoid of a spout extending downwardly from the opening formed in the lid.

3. The capped barrel system of claim 1, wherein the closure is non-frangible.

4. The capped barrel system of claim 1, wherein the closure includes a bottom fin that is positioned below the opening.

5. The capped barrel system of claim 4, wherein the opening has a first diameter; and wherein the bottom fin of the closure has a second diameter that is greater than the first diameter.

6. The capped barrel system of claim 5, wherein the closure includes a recessed portion positioned above the bottom fin; and wherein the recessed portion has a third diameter that is lesser than the second diameter.

7. The capped barrel system of claim 6, wherein the third diameter is substantially equal to the first diameter.

8. The capped barrel system of claim 6, wherein the closure includes a top fin having a fourth diameter that is greater than the first diameter and third diameter; and wherein the recessed portion is positioned between the bottom fin and the top fin.

9. The capped barrel system of claim 5, wherein the bottom fin includes a downward facing tapered portion.

10. The capped barrel system of claim 1, wherein the seal is comprised of thermoplastic elastomeric material.

11. The capped barrel system of claim 10, wherein the closure is comprised of thermoplastic elastomeric material.

12. The capped barrel system of claim 11, wherein the thermoplastic elastomeric material of the closure has a greater hardness than the thermoplastic elastomeric material of the seal.

13. The capped barrel system of claim 1, wherein the lid and the closure consist of the same material or materials.

14. The capped barrel system of claim 1, wherein the top portion of the lid is comprised of a first material having a first hardness; and wherein the seal of the lid is comprised of a second material having a second hardness that is lesser than the first hardness.

15. The capped barrel system of claim 1, wherein the lid is a first lid and the barrel cap is a first barrel cap;

wherein the capped barrel system further comprises a second barrel cap configured to be coupled to the barrel and including:

a second lid including: (i) a top portion positioned above the head of the barrel when the second barrel cap is coupled to the barrel, and (ii) a rim extending downwardly from the top portion, wherein the rim includes an inner surface, an outer surface, and a seal that defines at least a portion of the inner surface and cooperates with the exterior surface of the barrel to provide a gas tight fit between the barrel and the second barrel cap; and an opening formed in the top portion of the second lid that is generally aligned with the bunghole when the second barrel cap is coupled to the barrel;

wherein the seal of the first lid has a first thickness and the seal of the second lid has a second thickness that is different than the first thickness; and wherein the closure is positionable in opening of the second lid to seal the opening of the second lid.

* * * * *